US010940989B2

(12) United States Patent
French et al.

(10) Patent No.: US 10,940,989 B2
(45) Date of Patent: Mar. 9, 2021

(54) PILL DISPENSER

(71) Applicant: Berry Plastics Corporation, Evansville, IN (US)

(72) Inventors: Jordan French, Evansville, IN (US); Jason A. Rowe, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 15/396,983

(22) Filed: Jan. 3, 2017

(65) Prior Publication Data

US 2017/0190503 A1 Jul. 6, 2017

Related U.S. Application Data

(60) Provisional application No. 62/274,539, filed on Jan. 4, 2016.

(51) Int. Cl.

| | |
|---|---|
| ***B65D 83/04*** | (2006.01) |
| ***A61J 1/03*** | (2006.01) |
| ***A61J 1/00*** | (2006.01) |

(52) U.S. Cl.

CPC ..... *B65D 83/0427* (2013.01); *A61J 1/00* (2013.01); *A61J 1/03* (2013.01)

(58) Field of Classification Search

CPC ..... A61J 1/03; B65D 83/0427

See application file for complete search history.

(56) References Cited

U.S. PATENT DOCUMENTS

| | | | |
|---|---|---|---|
| 716,257 | A | 12/1902 | Lunt |
| 1,172,079 | A | 2/1916 | Lea Vell |
| 2,673,777 | A | 3/1954 | Ward |
| 2,683,554 | A | 7/1954 | Mulhauser, Jr. |
| 2,886,208 | A | 5/1959 | Sinclair |
| 2,918,167 | A | 12/1959 | Lowen |
| 2,962,190 | A | 11/1960 | Horland |
| 3,067,787 | A | 12/1962 | Salk |
| 3,159,308 | A | 12/1964 | Passavanti |
| 3,289,885 | A | 12/1966 | Villaveces |
| 3,325,052 | A | 6/1967 | Sauber |
| 3,586,208 | A | 6/1971 | Hussey |
| 3,610,468 | A | 10/1971 | Borsum |
| 3,622,041 | A | 11/1971 | Borsum |
| 3,627,160 | A | 12/1971 | Horvath |

(Continued)

FOREIGN PATENT DOCUMENTS

| | | | |
|---|---|---|---|
| CA | 2130881 | * | 2/1996 |
| CA | 2130881 A1 | | 2/1996 |

(Continued)

OTHER PUBLICATIONS

International (PCT) Search Report and Written Opinion for PCT App. No. PCT/US2017/12032 dated Apr. 3, 2017, BP-464 PCT II (5723-261380), 10 pages.

(Continued)

*Primary Examiner* — Gene O Crawford

*Assistant Examiner* — Kelvin L Randall, Jr.

(74) *Attorney, Agent, or Firm* — Barnes & Thornburg LLP

(57) ABSTRACT

A package includes a container formed to include an interior product-storage region and a closure. The closure is coupled to the container selectively to allow access to the product stored in the interior product-storage region.

17 Claims, 7 Drawing Sheets

(56) References Cited

U.S. PATENT DOCUMENTS

| | | | | | |
|---|---|---|---|---|---|
| 3,716,161 | A | | 2/1973 | Julian et al. | |
| 3,833,147 | A | | 9/1974 | Borsum | |
| 3,836,055 | A | * | 9/1974 | Katzmark | G01F 11/261 222/427 |
| 4,159,791 | A | * | 7/1979 | Crutcher | G01F 11/261 141/322 |
| 4,230,236 | A | | 10/1980 | Boulter | |
| 4,282,990 | A | | 8/1981 | Miyashita | |
| 4,283,000 | A | | 8/1981 | White | |
| 4,454,962 | A | | 6/1984 | Greenspan | |
| 4,530,447 | A | * | 7/1985 | Greenspan | B65D 83/04 221/288 |
| 4,653,668 | A | | 3/1987 | Gibilisco | |
| 4,744,492 | A | | 5/1988 | Hackmann | |
| 4,805,765 | A | | 2/1989 | Barrett | |
| 4,848,593 | A | | 7/1989 | Jeandaud | |
| 4,887,738 | A | | 12/1989 | Jennings | |
| 4,971,203 | A | | 11/1990 | Weinstein | |
| 5,018,644 | A | | 5/1991 | Hackmann | |
| 5,020,719 | A | | 6/1991 | Roth | |
| 5,108,006 | A | | 4/1992 | Tieke | |
| 5,405,047 | A | | 4/1995 | Hansen | |
| 5,443,204 | A | | 8/1995 | O'Donnell | |
| 5,467,903 | A | * | 11/1995 | Sorensen | G01F 11/261 222/455 |
| 5,711,463 | A | * | 1/1998 | Chen | G01F 11/261 222/456 |
| 5,873,493 | A | * | 2/1999 | Robinson | G01F 11/262 222/109 |
| 5,897,025 | A | | 4/1999 | Flewitt | |
| 6,267,265 | B1 | | 7/2001 | Issa | |
| 6,695,178 | B2 | * | 2/2004 | Eppler | B65D 5/76 222/159 |
| 7,147,130 | B1 | | 12/2006 | Clark | |
| 7,780,008 | B2 | * | 8/2010 | Portier | B65D 51/185 206/540 |
| 8,322,567 | B2 | | 12/2012 | Giraud | |
| 8,469,194 | B2 | | 6/2013 | Johnson | |
| 9,656,796 | B1 | | 5/2017 | Cammarata | |
| 2004/0045978 | A1 | | 3/2004 | Peng | |
| 2004/0124204 | A1 | | 7/2004 | Giraud | |
| 2009/0194556 | A1 | | 8/2009 | Klein | |
| 2011/0147252 | A1 | * | 6/2011 | Rasheed | B65D 83/0481 206/438 |
| 2011/0147404 | A1 | | 6/2011 | Dobie, III | |
| 2011/0155757 | A1 | * | 6/2011 | Hsia | |
| 2015/0266654 | A1 | | 9/2015 | Baarman | |
| 2015/0368011 | A1 | * | 12/2015 | Groubert | B65D 83/04 220/200 |
| 2017/0036846 | A1 | | 2/2017 | Bressan | |
| 2017/0190503 | A1 | | 7/2017 | French | |

FOREIGN PATENT DOCUMENTS

| | | | | |
|---|---|---|---|---|
| WO | 02009012080 | | 1/2009 | |
| WO | WO-2013172487 | A1 * | 11/2013 | A61J 7/0076 |

OTHER PUBLICATIONS

Office Action dated Mar. 7, 2018 for U.S. Appl. No. 15/647,404 (pp. 1-13).

Office Action dated Aug. 23, 2018 for U.S. Appl. No. 15/647,404, BP-502 US-U || (5723-267430), (pp. 1-17).

Office Action dated Jan. 4, 2019 for U.S. Appl. No. 15/647,404, BP-502 US-U || (5723-267430), (pp. 1-11).

Chinese Office Action for Chinese App. No. 201780011765.7 dated Apr. 28, 2019, BP-464 CN || (5723-280103), 14 pages.

Office Action dated Aug. 21, 2019 for U.S. Appl. No. 15/647,404, BP-502 US-U || (5723-267430), (pp. 1-17).

Extended European Search Report for European Pat. App. No. 177361995 dated Aug. 19, 2019, BP-464 EP || (5723-280104), 6 pages.

Chinese Office Action for Chinese App. No. 201780011765.7 dated Dec. 26, 2019, BP-464 CN || (5723-280103), 6 pages.

Third Chinese Office Action for Chinese App. No. 201780011765.7 dated Jul. 1, 2020, BP-464 CN || (5723-280103), 4 pages.

Indian First Examination Report for Indian App. No. 201817028399 dated Oct. 7, 2020, BP-464 in || , 6 pages.

* cited by examiner

PILL DISPENSER

PRIORITY CLAIM

This application claims priority under 35 U.S.C. § 119(e) to U.S. Provisional Application Ser. No. 62/274,539, filed Jan. 4, 2016, which is expressly incorporated by reference herein.

BACKGROUND

The present disclosure relates to a package, and in particular, to a package including a container and a container closure. More particularly, the present disclosure relates to a package which may be used as a pill dispenser.

SUMMARY

In accordance with the present disclosure, a package includes a container and a container closure. The container is formed to include an interior product-storage chamber and the closure is coupled selectively to the container to block access to products stored in the interior product-storage region.

In illustrative embodiments, the package may be used as pill dispenser. The pill dispenser comprises the container including a body and a neck, the closure, and a neck insert. The neck insert is coupled to a neck of the container and arranged to extend downwardly into an interior pill-storage chamber formed in the container. The neck insert is formed to include a pill-dispensing outlet. The neck insert includes a pill-receiver dish that is arranged to open upwardly away from the container to face toward an underside of the container closure when the container closure is in a closed position coupled to the neck of the container covering the pill-dispensing outlet.

In illustrative embodiments, a user obtains pills from the interior product-storage chamber by first inverting the pill dispenser and then returning the pill dispenser to an upright position. As a result, a limited number of pills move from the interior pill-storage chamber through the pill-dispensing outlet and rest on the pill-receiver dish so that a user can remove a desired number of pills.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is a view similar to FIG. 3 suggesting rotation of the pill dispenser in a clockwise direction while the container closure remains closed;

FIG. 10 is a view similar to FIG. 9 after partial inversion of the pill dispenser to cause a pill to pass from the interior pill-storage chamber formed in the container through the pill-dispensing outlet formed in the ceiling of the neck insert into the pill-transfer chamber defined between a top side of the ceiling and an underside of the container closure;

FIG. 11 is a view similar to FIGS. 9 and 10 after rotation of the pill dispenser in a counterclockwise direction away from the partially inverted position of FIG. 10 toward a right-side-up position shown in FIG. 12 to cause the discharged pill to travel in the pill-transfer chamber relative to the container closure from the pill-dispensing outlet toward the pill-receiver dish;

FIG. 12 is an upright view similar to FIG. 9 showing that the discharged pill has now fallen into the upwardly facing pill-receiver dish formed in the ceiling of the neck insert so that it is available to a user upon opening the container closure as suggested in FIG. 6.

FIG. 20 is a sectional view similar to FIG. 15 suggesting rotation of the pill dispenser in a clockwise direction while the flip-top cap remains closed;

FIG. 21 is a view similar to FIG. 20 after partial inversion of the pill dispenser to cause a pill to pass from the interior pill-storage chamber formed in the container through a pill-dispensing outlet formed in the ceiling of the body into a pill-transfer chamber defined between a top side of the ceiling and an underside of the flip-top cap;

FIG. 22 is a view similar to FIGS. 20 and 21 after rotation of the pill dispenser in a counterclockwise direction away from the partially inverted position of FIG. 21 toward a right-side-up position shown in FIG. 23 to cause the discharged pill to travel in the pill-transfer chamber relative to the flip-top cap from the pill-dispensing outlet toward the pill-receiver dish; and FIG. 23 is an upright view similar to FIG. 20 showing that the discharged pill has now fallen into the upwardly facing pill-receiver dish formed in the ceiling of the body so that it is available to a user upon opening the flip-top cap as suggested in FIG. 16.

DETAILED DESCRIPTION

A first embodiment of a pill dispenser in accordance with the present disclosure is shown in FIGS. 1-12. A second embodiment of a pill dispenser 10 in accordance with the present disclosure is shown in FIGS. 13-23. Pill dispenser 10, 210 is configured to dispense a predetermined number of pills, for example, one pill 11, 211 during an inversion process as shown in FIGS. 9-12 and 20-23. When pill dispenser 10, 210 is inverted, a single pill 11, 211 passes through a pill-transfer chamber 11T, 211T to a pill-receiver dish 16D, 216D allowing a user to obtain a single pill 11, 211. This process may minimize an unexpected release of additional pills 11, 211 from the container 12, 212 during a pill retrieval process.

Figure 2:
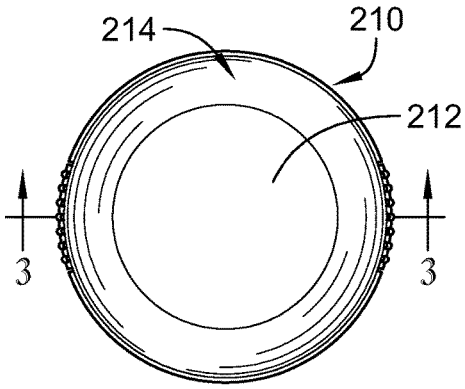
FIG. 2 is a top plan view of the pill dispenser of FIG. 1.
Figure 1:
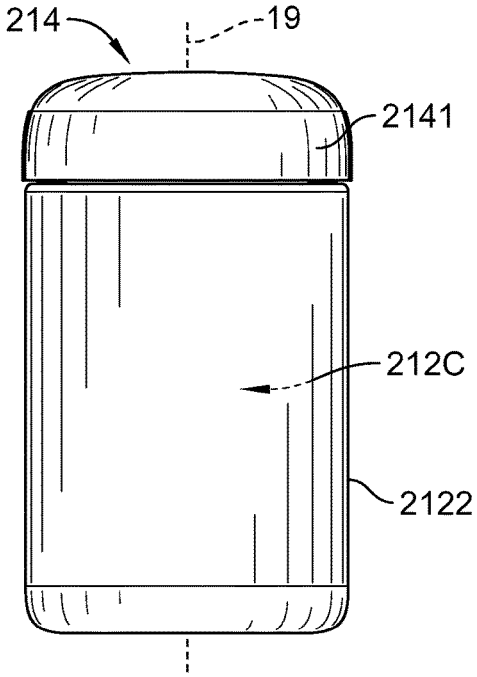
FIG. 1 is a side elevation view of a first embodiment of a pill dispenser in accordance with the present disclosure showing a container closure mounted on an underlying container.
Figure 3:
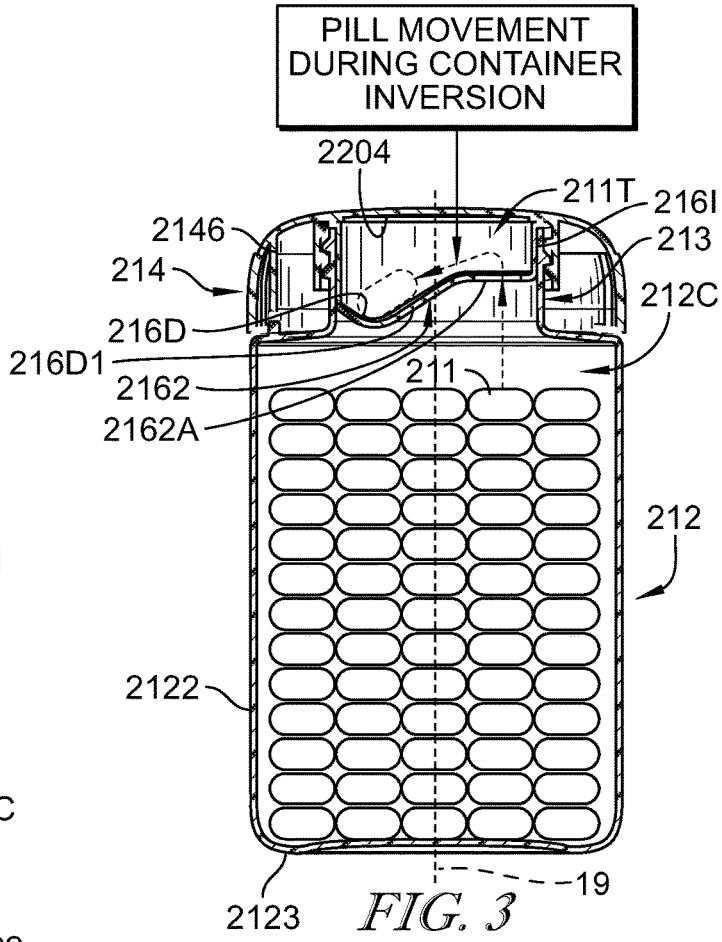
FIG. 3 is an enlarged sectional view of the pill dispenser taken along line 3-3 of FIG. 2 showing many pills stored in the interior pill-storage chamber formed in the container and singling out one of those pills and showing a discharge-and-transfer flow path along which a selected pill travels to deposit that pill in an upwardly opening pill-receiver dish formed in a neck insert as a result of inversion of the pill dispenser in a manner suggested in FIGS. 9-12.
Figure 4:
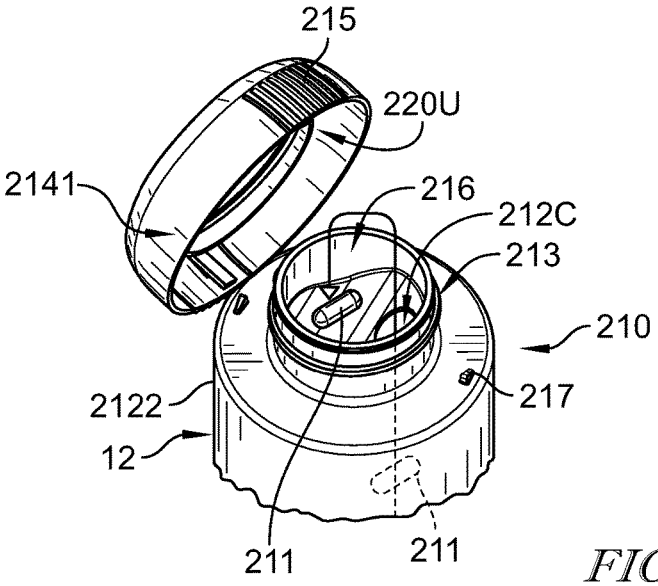
FIG. 4 is an enlarged partial perspective view of an upper portion of the pill dispenser of FIGS. 1-3 showing that the container closure is removed from a brim of the underlying container to expose the neck insert including the semi-circular-shaped upwardly opening pill-receiver dish alongside a pill-dispensing outlet and showing a selected pill has been discharged from the interior pill-storage chamber formed in the container through the pill-dispensing outlet, moved along the discharge-and-transfer flow path shown in FIG. 3, and then transferred into the pill-receiver dish so that it is available to a user once the container closure is removed.
Figure 5:
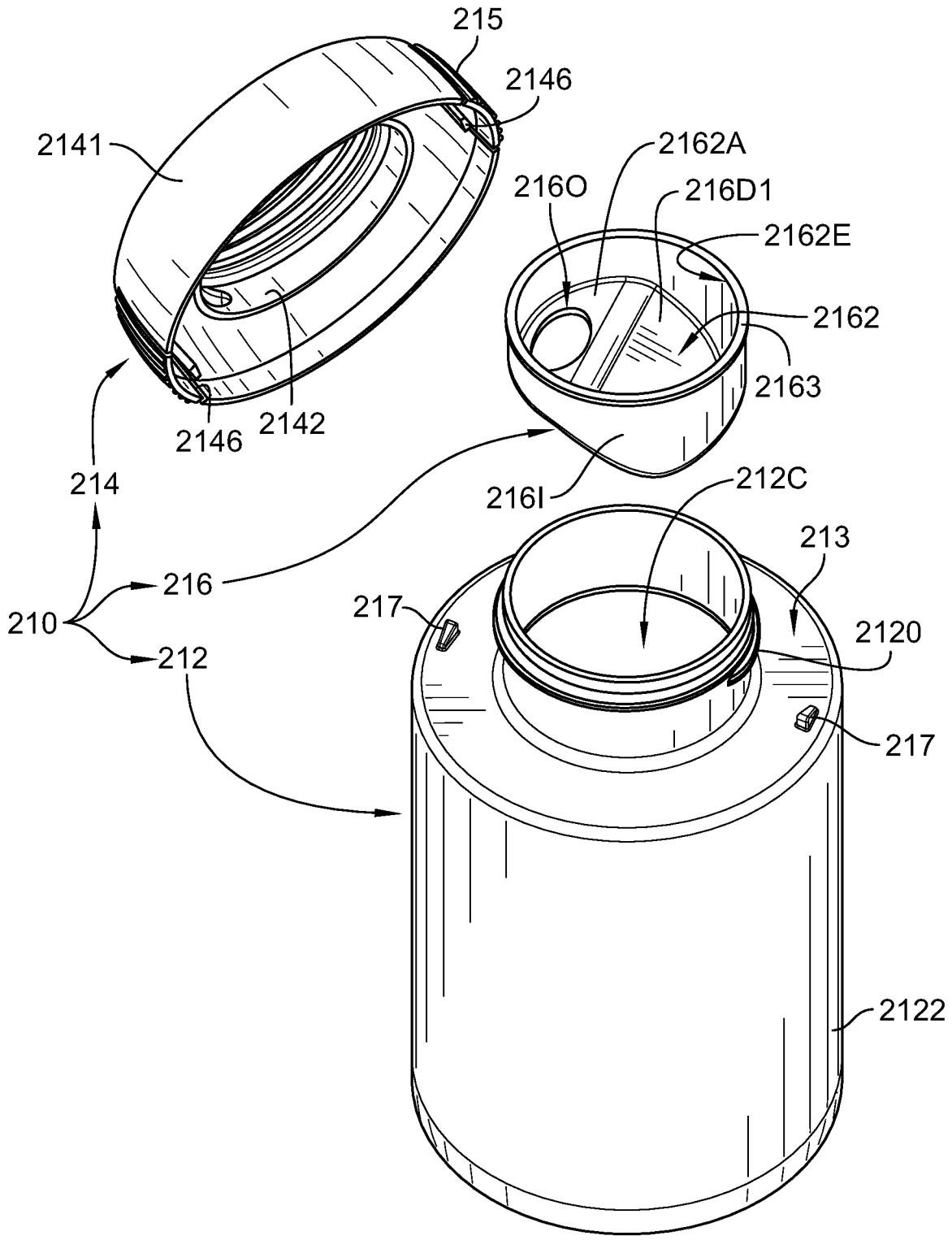
FIG. 5 is an exploded assembly view of the pill dispenser of FIG. 1 showing, from bottom to top, the container, the neck insert, and the container closure.
Figure 6:
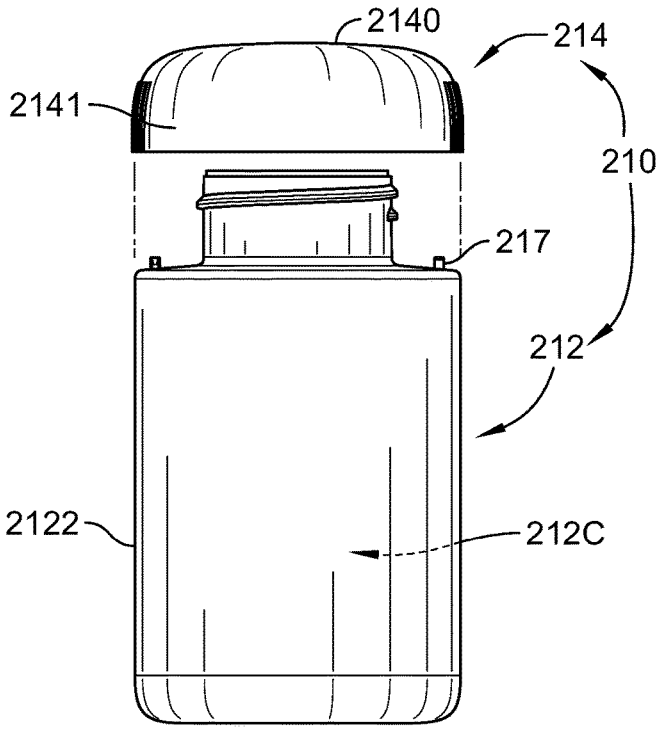
FIG. 6 is a view of the pill dispenser of FIG. 1 before the container closure is mated to the neck of the underlying container.

A first embodiment of pill dispenser 210 in accordance with the present disclosure is shown in FIGS. 1-12. Pill dispenser 210 includes a container 212, a container closure 214, and a neck insert 216 as shown in FIG. 5. Neck insert 216 is configured to be mounted within a neck 213 included in container 212 as suggested in FIGS. 3-5. Neck insert 216 is formed to include a pill-dispensing outlet 216O arranged to be alongside a pill-receiver dish 216D. Pill-dispensing outlet 216O is arranged to open into an interior pill-storage chamber 212C formed in container 212 as shown, for example, in FIGS. 3 and 4. Container closure 214 mounts removably on neck 213 as shown in FIGS. 5 and 6. A pill-discharge sequence illustrated in FIGS. 9-12 shows how a single pill 211 move be moved from interior pill-storage chamber 212C through a pill-transfer chamber 211T provided between container closure 214 and neck insert 216 while container closure 214 is mounted on neck 213 to pill-receiver dish 216D by first inverting pill dispenser 210 and then restoring pill dispenser 210 to an upright orientation.

Neck insert 216 is arranged to lie within an annular interior space formed in neck 213 to block selectively access to interior pill-storage chamber 212C as shown in FIGS. 3 and 5. Illustratively, neck insert 216 may be removed from neck 213 for filling interior pill-storage chamber 212C with pills 211.

Figure 7:
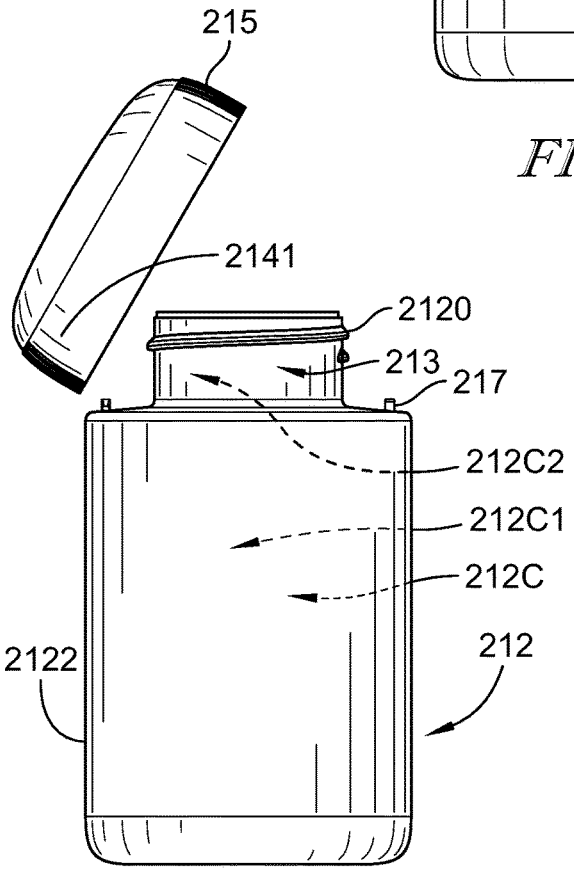
FIG. 7 is a side elevation view of the pill dispenser of FIG. 4.

Container 212 includes neck 213, a floor 2123 arranged to lie below neck 213, and a side wall 2122 arranged to interconnect neck 213 and floor 2123 as shown, For example, in FIGS. 4 and 7. Exterior threading 2120 is coupled to neck 213 and arranged to mate with interior Threading 2142 included in container closure 214 as suggested in FIG. 5. Neck insert 216 may be retained within Neck 213 of container 212 by an interference fit, adhesive, Combinations thereof, or any other suitable alternative. Container 212 may be any suitable size and shape. While neck 213 has an annular shape in the illustrated embodiment, any suitable shape may be used in accordance with the present Disclosure. The container 212 is formed to include an interior pill-storage chamber 212C. The container 212 includes a body 2122 defining a portion 212C1 of the interior pill-storage chamber 212C and a neck 213 coupled to the body 2122 to define a remaining portion 212C2 of the interior pill-storage chamber 212C.

Container closure 214 includes a rim 2141 that mates with neck 213 of container 212, grips 215, and a cap 2140. Cap 2140 is coupled to a top edge of rim 2141 and arranged to overlie the interior pill-storage chamber 212C that is formed in container 212 as suggested in FIG. 9. Grips 215 are located on an exterior surface of rim 2141 and overlie locking ridges 2146 of container closure 214. Security tabs 217 are located on an upwardly facing surface of neck 213 when container closure 214 is mounted on neck 213. When pressure is applied inwardly on grips 215, locking ridges 2146 release from security tabs 217 and allow container closure 214 to rotate freely along the interior threading 2142. Interior threading 2142 is coupled to an interior surface of container closure 214 as shown, for example, in FIG. 5 and configured to mate with exterior threading 2120 coupled to an exterior surface of neck 213 of container 212.

Neck insert 216 includes a pill-receiver dish 216D that is arranged to open upwardly away from container 212 to face toward an underside 220U of container closure 214 when container closure 214 is coupled to neck 213 in a closed position to cover the pill-dispensing outlet 216O as suggested in FIGS. 3 and 9-12. Pill-receiver dish 216D has a semi-circular shape in an illustrative embodiment. In another example, the pill-receiver dish 216D has a concave shape in cross-section providing an upper curved surface that is arranged to face toward the container closure 214 and is arranged to extend away from the container closure 214 as show in FIG. 3. However, any suitable shape may be used in accordance with the present disclosure. Neck insert 216 further includes a retaining lip 2163 located on a top edge of neck insert 216 and is configured to retain neck insert 216 in the neck 213 of container 212 as shown in FIG. 5.

Neck insert 216 further includes an insert side wall 216I as shown in FIGS. 3 and 5. Insert side wall 216I is arranged to extend between and interconnect the retaining lip 2163 and the ceiling 2162. Insert side wall 216I is arranged to extend downwardly along an inner surface of the neck 213 in inter pill-storage region 212*c*.

Figure 8:
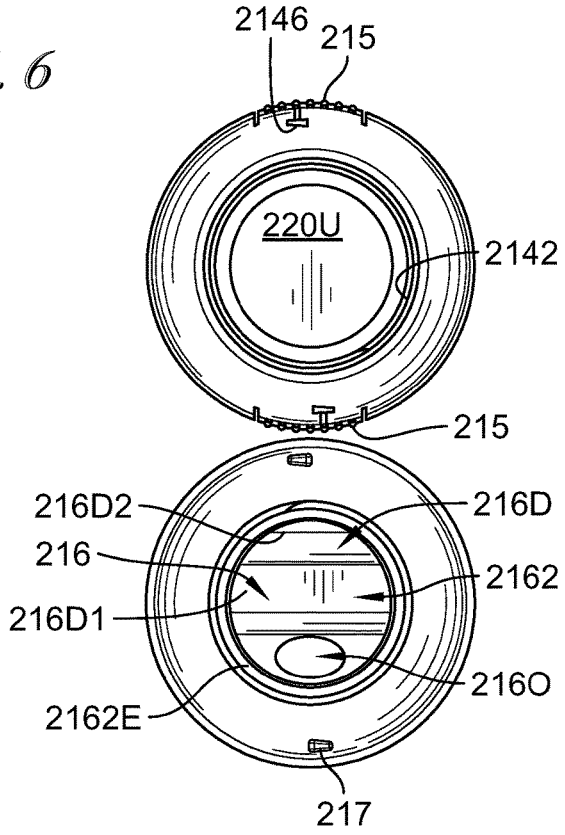
FIG. 8 is a top plan view of the pill dispenser of FIG. 7 when the container closure is removed and showing that a ceiling of the neck insert is formed to include the oval-shaped pill-dispensing outlet along a perimeter edge of the ceiling and the semi-circular-shaped pill-receiver dish located between the pill-dispensing outlet and the rim of the container.

Ceiling 2162 of the neck insert 216 is also formed to include a pill-dispensing outlet 216O opening into interior pill-storage chamber 212C as suggested in FIGS. 4 and 8. In an illustrative embodiment, pill-dispensing outlet 216O has a generally oblong or oval shape. In another embodiment, the shape of pill-dispensing outlet 216O may be squarer, circular, or any other suitable alternative.

Ceiling 2162 includes a horizontal platform 2162A and ramp 2161D1 as shown in FIG. 5. Horizontal platform 2162A is formed to include the pill-dispensing outlet 216O. Ramp 2162A is arranged to extend between and interconnect the pill-receiver dish 216D and the horizontal platform 2162A. As suggested in FIGS. 3 and 5, both the horizontal platform 2162A and the ramp 2161D1 are flat while the pill-receiver dish 216D is curved. As shown in FIG. 3, the ramp 2161D1 has a negative slope which extends downwardly toward pill-receiver dish 216D. Pill-receiver dish 216D also includes a curved side 216D2 arranged to present a concave edge facing toward pill-dispensing outlet 216O and arranged to extend along and in spaced-apart relation to a circular perimeter edge 2162E of neck insert 216 as shown, for example, in FIGS. 5 and 8.

Pill-dispensing outlet 216O is located near a perimeter edge 2162E of ceiling 2162 of neck insert 216, and radially offset from a central vertical axis 19 of the insert so that the central vertical axis 19 intersects the ramp of ceiling 2162. When pill dispenser 210 is turned upside down while container closure 214 is in the closed position, discharge of a pill 211 from interior pill-storage chamber 212C through pill-dispensing outlet 216O into a pill-transfer chamber 211T defined between ceiling 2162 of neck insert 216 and underside 220U of container closure 214 as suggested in FIGS. 3 and 4. The discharged pill 211 will in turn flow around, for example, the dome-shaped underside 220U of container closure 214 and fall into the upwardly opening semi-circular shaped pill-receiver dish 216D as the inverted pill dispenser 210 is returned to its regular upright orientation as Suggested in FIG. 3. In one example, the dome shaped underside 220U has a concave surface arranged to extend upwardly way from the neck insert 216. Then a user may open container closure 214 and remove pill 211 that is at rest in pill-receiver dish 216D.

A sequence illustrating discharge of a pill 211 from interior pill-storage chamber 212C formed in container 212 through pill-dispensing outlet 216O formed in ceiling 2162 of neck insert 216 first into a pill-transfer chamber 211T formed between a top side of the ceiling 2162 and an underside 220U of container closure 214 while container closure 214 remains in a closed position on neck insert 216 and then into an upwardly opening pill-receiver dish 216D formed in ceiling 2162 and arranged to lie alongside the pill-dispensing outlet 216O as shown, for example, in FIGS. 9-12.

Figure 9:
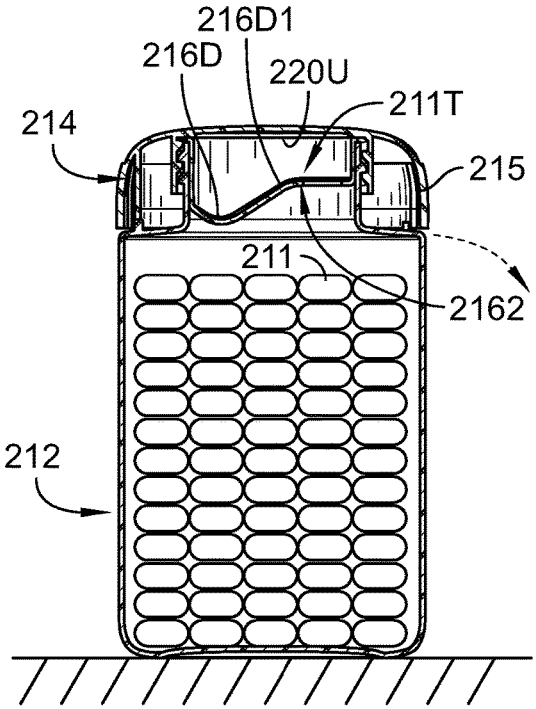
FIGS. 9-12 are a series of views showing discharge of a pill from the interior pill-storage chamber formed in the container through the pill-dispensing outlet formed in the ceiling of the neck insert first into a pill-transfer chamber formed between a top side of the ceiling and an underside of the container closure while the container closure remains in a closed position on the container and then into the upwardly opening pill-receiver dish included in the ceiling and arranged to lie alongside the pill-dispensing outlet.

A pill-dispensing event is initiated once a user rotates pill dispenser 210 in a clockwise direction as suggested in FIG. 9 while container closure 214 remains in a closed position on container 212. After partial inversion of the pill dispenser 210 as suggested in FIG. 10, a pill 211 is caused to pass from the interior pill-storage chamber 212C formed in container 212 through a pill-dispensing outlet 216O formed in ceiling 2162 of neck insert 216 into a pill-transfer chamber 211T defined between a top side of ceiling 2162 and an underside 220U of container closure 214.

Figure 10:
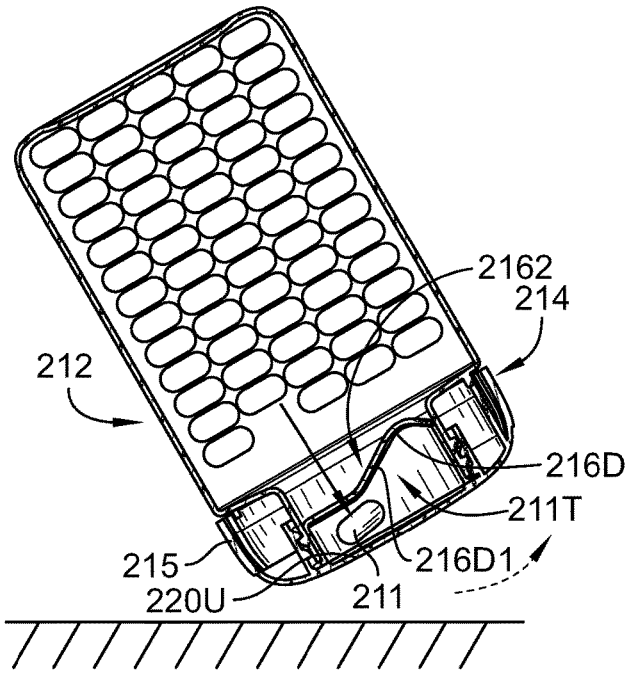
Figure 11:
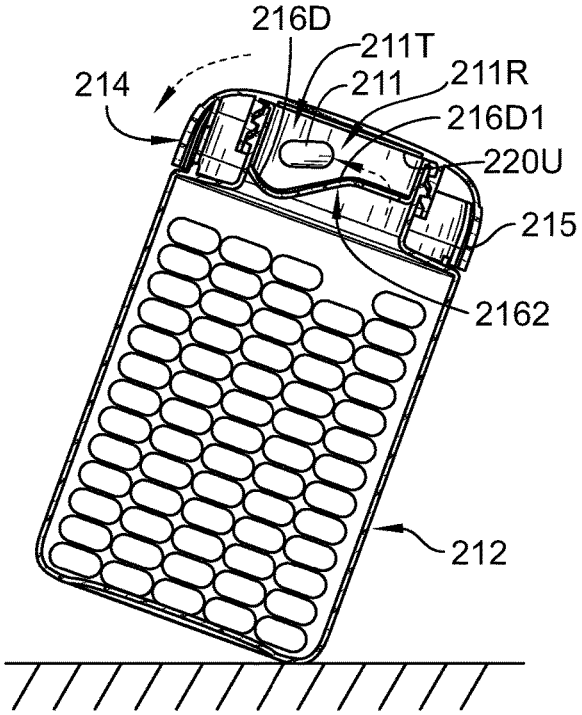
Figure 12:
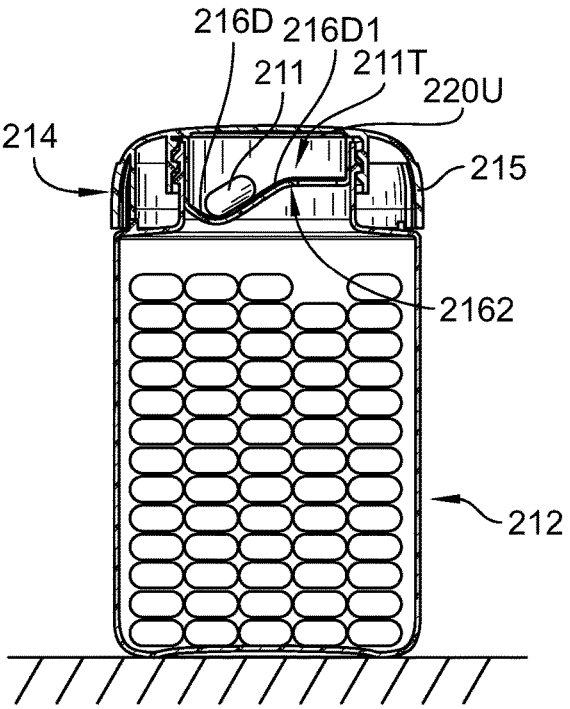
Figure 14:
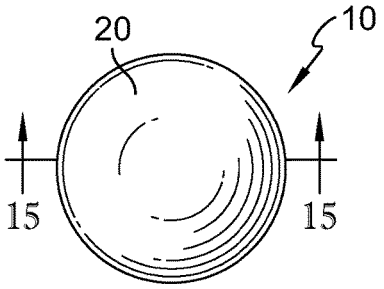
FIG. 14 is a top plan view of the pill dispenser of FIG. 13.

After further rotation of pill dispenser 210 in a counter-clockwise direction away from the partially inverted position of FIG. 10 toward a right-side-up position shown in FIG. 11, the discharged pill 211 is caused to travel in a pill transfer region 211R in the pill-transfer chamber 211T relative to container closure 214 from pill-dispensing outlet 216O toward pill-receiver dish 216D. Once pill dispenser 210 is restored to an upright orientation as Suggested in FIG. 12, discharged pill 211 has now fallen into the upwardly facing pill-receiver dish 216D formed in ceiling 2162 of neck insert 216 so that it is available to a user upon opening the container closure 214 as Suggested in FIG. 4.

Pill-dispensing opening 216O is placed near the perimeter edge 2162E of ceiling 2162 of neck insert 216 of container closure 214 as suggested in FIGS. 4 and 5. Such placement permits pouring out of the pill 211 when pill dispenser 210 is turned upside down so that the pill 211 in turn flows through pill-transfer chamber 211T and around the dome-shaped underside 220U of container closure 214 and into the pill-receiver dish 216D formed in neck insert 216 of container closure 214 as suggested in FIGS. 9-12. In accordance with the present disclosure, the space provided between underside 220U of container closure 214 and the top surface of ceiling 2162 of neck insert 216 can regulate the number of pills that are disbursed and fall to rest in pill-receiver dish 216D.

In another example, a pill-dispensing event is initiated once a user rotates pill dispenser 210 in a clockwise direction while container closure 214 is absent. Neck insert 216 provides means for dispensing fewer pills at a time which allows for better control and reduced spilling when compared to a pill-dispensing event using a container without neck insert 216.

A foil seal (not shown) may be coupled to neck 213, container 212, or neck insert 216 to cover the top aperture opening into interior pill-storage chamber 212C.

Figure 13:
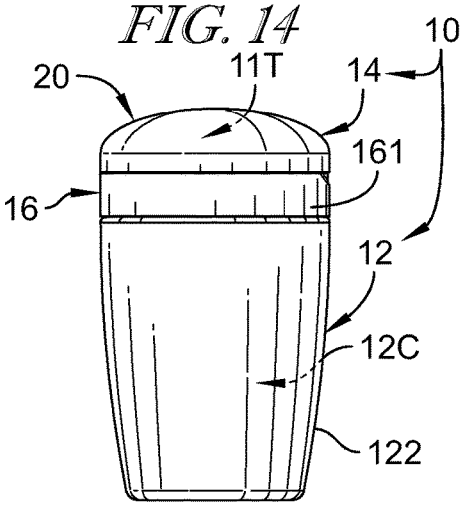
FIG. 13 is a side elevation view of another embodiment of a pill dispenser in accordance with the present disclosure showing a container closure mounted on an underlying container.
Figure 15:
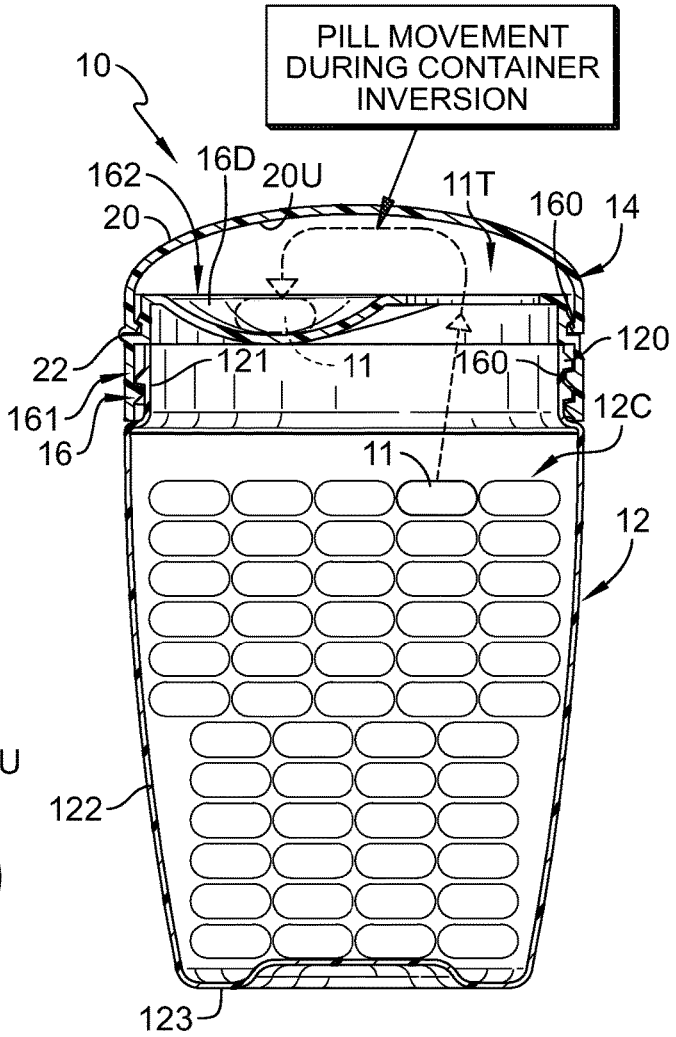
FIG. 15 is an enlarged sectional view of the pill dispenser taken along line 15-15 of FIG. 14 showing many pills stored in the interior pill-storage chamber formed in the container and singling out one of those pills (shown in bold) and showing a discharge-and-transfer flow path along which a selected pill travels to deposit that pill in an upwardly opening pill-receiver dish formed in the container closure as a result of inversion of the pill dispenser in a manner suggested in FIGS. 20-23.
Figure 16:
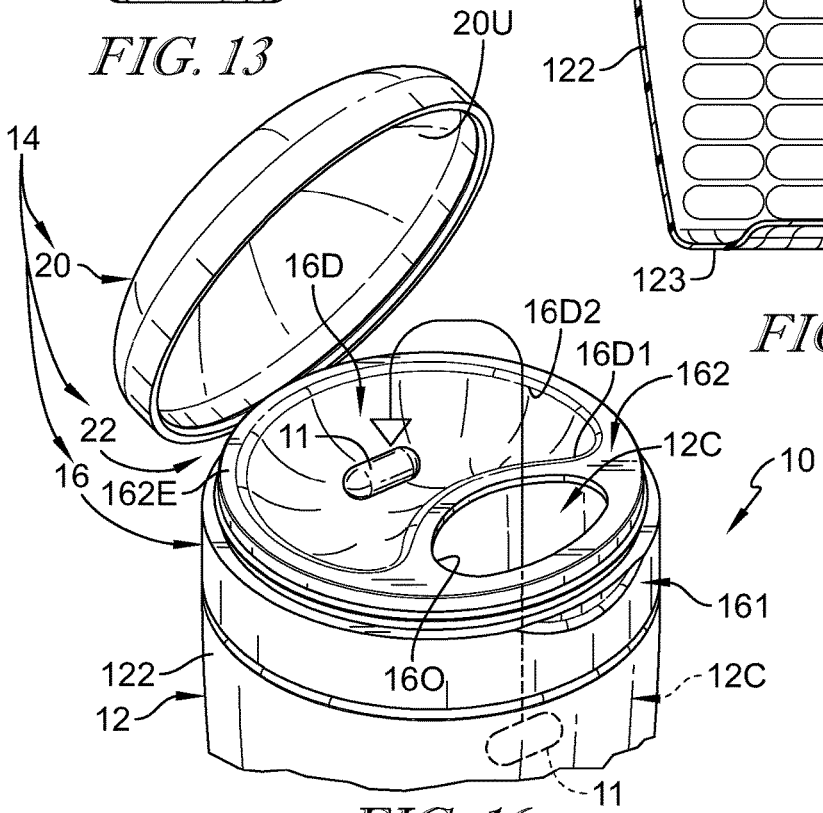
FIG. 16 is an enlarged perspective view of an upper portion of the pill dispenser of FIGS. 13-15 showing that the container closure includes a body mated to a brim of an underlying container and including a crescent-shaped upwardly opening pill-receiver dish alongside an oval-shaped pill-dispensing outlet, a flip-top cap, and a hinge interconnecting the body and the flip-top cap, and showing the flip-top cap after it has been moved to an opened position on the hinge relative to the body to reveal a selected pill that has been discharged from the interior pill-storage chamber formed in the container through the pill-dispensing outlet, moved along the discharge-and-transfer flow path shown in FIG. 15, and then transferred into the pill-receiver dish so that it is available to a user once the flip-top cap is opened.
Figure 17:
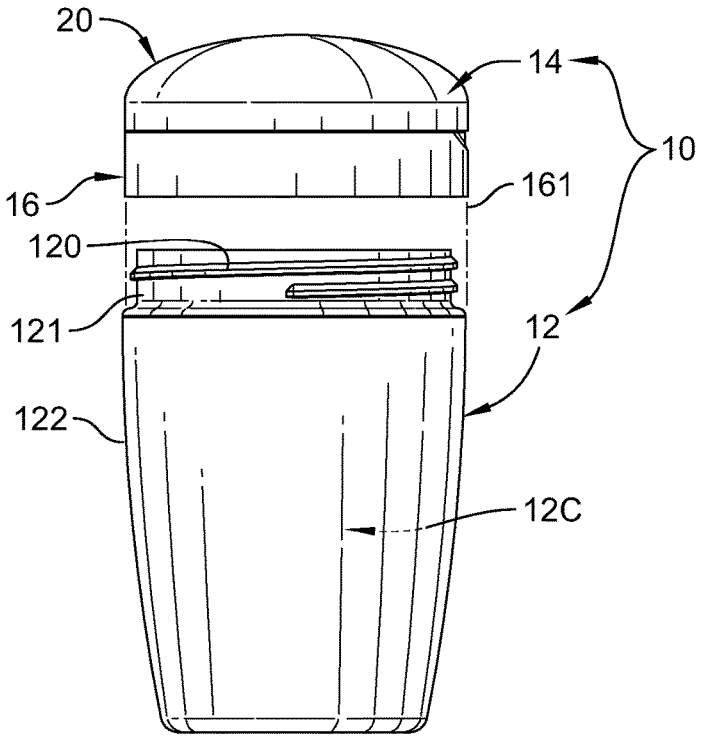
FIG. 17 is a view of the pill dispenser of FIG. 13 before the container closure is mated to the brim of the underlying container.
Figure 18:
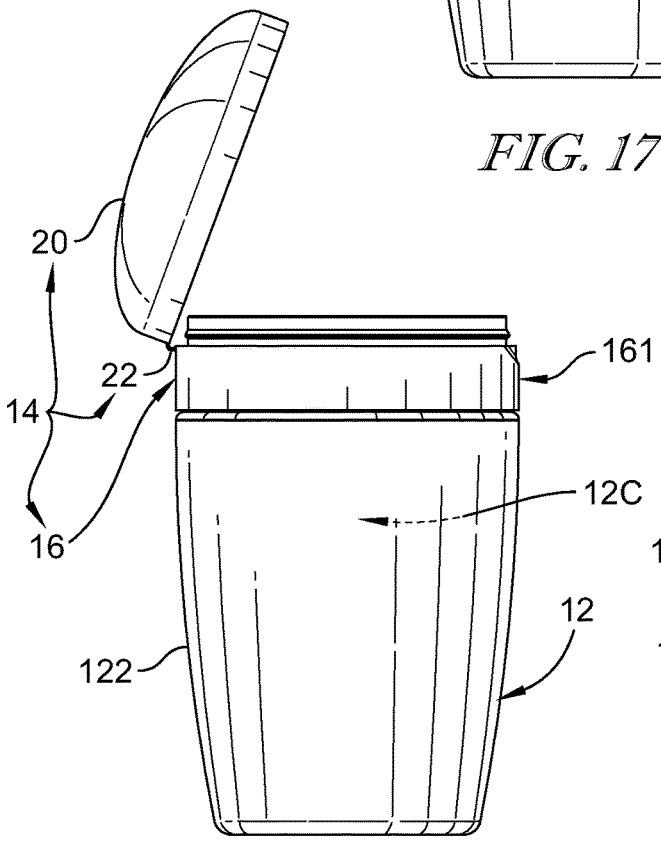
FIG. 18 is a side elevation view of the pill dispenser shown in FIG. 16.

Pill dispenser 10 includes a container 12 and a container closure 14 having a body 16 configured to be mounted on a brim 18 of container 12 as suggested in FIGS. 13, 15, and 17. Body 16 is formed to include a pill-dispensing outlet 16O arranged to be alongside a pill-receiver dish 16D and to open into an interior pill-storage chamber 12C formed in container 12 as shown, for example, in FIGS. 15 and 16. Container closure 14 also includes a flip-top cap 20 mounted on a hinge 22 for movement between a closed position shown in FIG. 15 and an opened position shown in FIG. 16.

A pill-discharge sequence illustrated in FIGS. 20-23 shows how a single pill 11 can be moved from interior pill-storage chamber 12C through a pill-transfer chamber 11T provided between flip-top cap 20 and body 16 while flip-top cap 20 is closed to pill-receiver dish 16D by first inverting pill dispenser 10 and then restoring pill dispenser 10 to an upright orientation.

Container 12 includes a brim 121, a floor 123 arranged to lie below brim 121, and a side wall 122 arranged to interconnect brim 121 and floor 123 as shown, for example, in FIGS. 15 and 17. Exterior threading 120 is coupled to brim 121 and arranged to mate with interior threading 160 included in body 16 of container closure 14 as suggested in FIG. 15. It is within the scope of this disclosure to retain base 16 of container closure 14 on container 12 using any suitable means and to provide container 12 with any suitable size and shape. While brim 121 has an annular shape in the illustrated embodiment, any suitable shape could be used in accordance with the present disclosure.

Container closure 14 includes a body 16 having a rim 161 that mates with brim 121 of container 12 and a ceiling 162 that is coupled to a top edge of rim 161 and arranged to overlie the interior pill-storage chamber 12C that is formed in container 12 as suggested in FIGS. 15 and 16. Interior threading 160 is coupled to an interior surface of rim 161 as shown, for example, in FIG. 15 and configured to mate with exterior threading 120 coupled to an exterior surface of brim 121 of container 12.

Ceiling 162 of the body 16 is formed to include a pill-receiver dish 16D that is arranged to open upwardly away from container 12 to face toward an underside 20U of flip-top cap 20 when flip-top cap 20 occupies a closed position on body 16 to cover the pill-dispensing outlet 16O as suggested in FIGS. 15 and 20-23. Pill-receiver dish 16D has a crescent shape in an illustrative embodiment; however, any suitable shape could be used in accordance with the present disclosure.

Ceiling 162 of the body 16 is also formed to include a pill-dispensing outlet 16O opening into interior pill-storage chamber 12C as suggested in FIG. 16. In an illustrative embodiment, pill-dispensing outlet 16O has a generally oblong or oval shape and pill-receiver dish 16D has a short curved side 16D1 arranged to present a concave edge wrapping around a portion of pill-dispensing outlet 16O as shown, for example, in FIGS. 16 and 19. Pill-receiver dish 16D also includes a long curved side 16D2 arranged to present a convex edge facing away from pill-dispensing outlet 16O and arranged to extend along and in spaced-apart relation to a circular perimeter edge 162E of ceiling 162 as shown, for example, in FIGS. 16 and 19.

In illustrative embodiments, pill-dispensing outlet 16O is located near a perimeter edge 162E of the ceiling 162 of the body 16 to permit, when pill dispenser 10 is turned upside down while flip-top cap 20 is in the closed position, discharge of a pill 11 from interior pill-storage chamber 12C through pill-dispensing outlet 16O into a pill-transfer chamber 11T defined between ceiling 162 of body 16 and underside 20U of flip-top cap 20 as suggested in FIGS. 15 and 16. The discharged pill 11 will in turn flow around, for example, the dome-shaped underside 20U of flip-top cap 20 and fall into the upwardly opening crescent-shaped pill-receiver dish 16D as the inverted pill dispenser 10 is returned to its regular upright orientation as suggested in FIG. 15. Then a user can open the flip-top cap 20 and remove the pill 11 that is at rest in the pill-receiver dish 16D.

A sequence illustrating discharge of a pill 11 from interior pill-storage chamber 12C formed in container 12 through pill-dispensing outlet 16O formed in ceiling 162 of body 16 first into a pill-transfer chamber 11T formed between a top side of the ceiling 162 and an underside 20U of flip-top cap 20 while flip-top cap 20 remains in a closed position on body 16 and then into an upwardly opening pill-receiver dish 16D formed in ceiling 162 and arranged to lie alongside the pill-dispensing outlet 16O as shown, for example, in FIGS. 20-23.

A pill-dispensing event is initiated once a user rotates pill dispenser 10 in a clockwise direction as suggested in FIG. 8 while flip-top cap 20 remains in a closed position on body 16. After partial inversion of the pill dispenser 10 as suggested in FIG. 21, a pill 11 is caused to pass from the interior pill-storage chamber 12C formed in container 12 through a pill-dispensing outlet 16O formed in ceiling 162 of body 16 into a pill-transfer chamber 11T defined between a top side of ceiling 162 and an underside 20U of flip-top cap 20.

Figure 21:
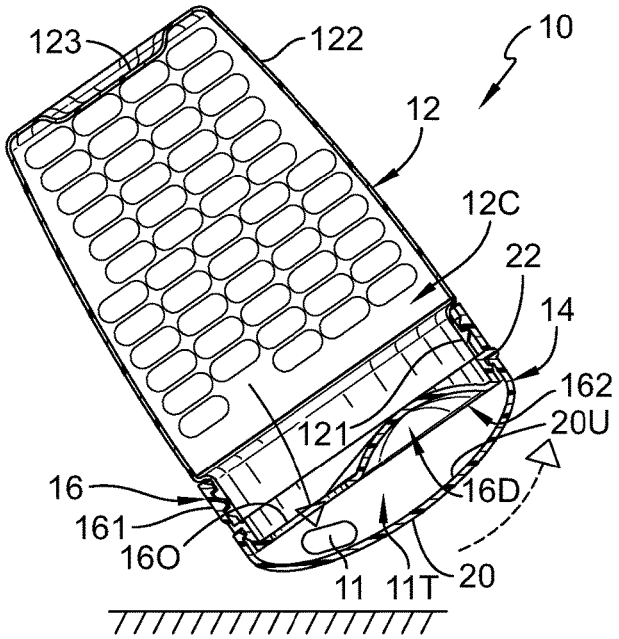
Figure 22:
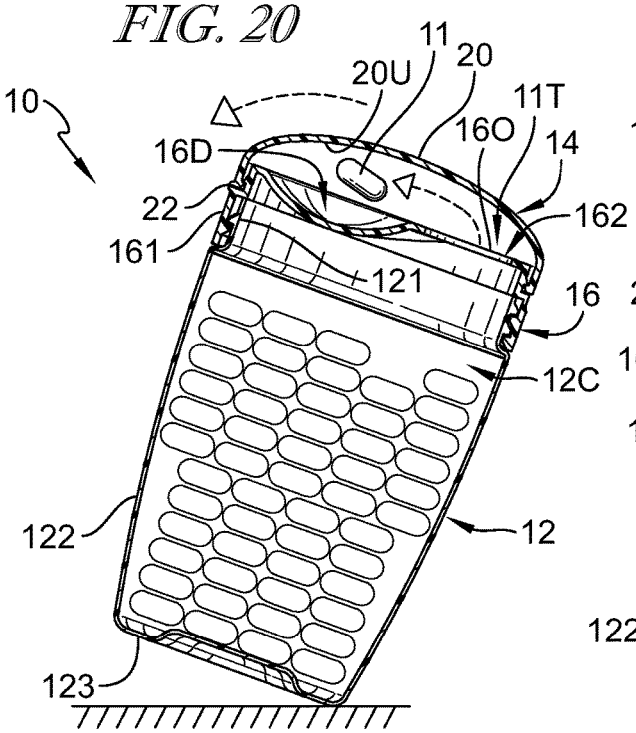
Figure 23:
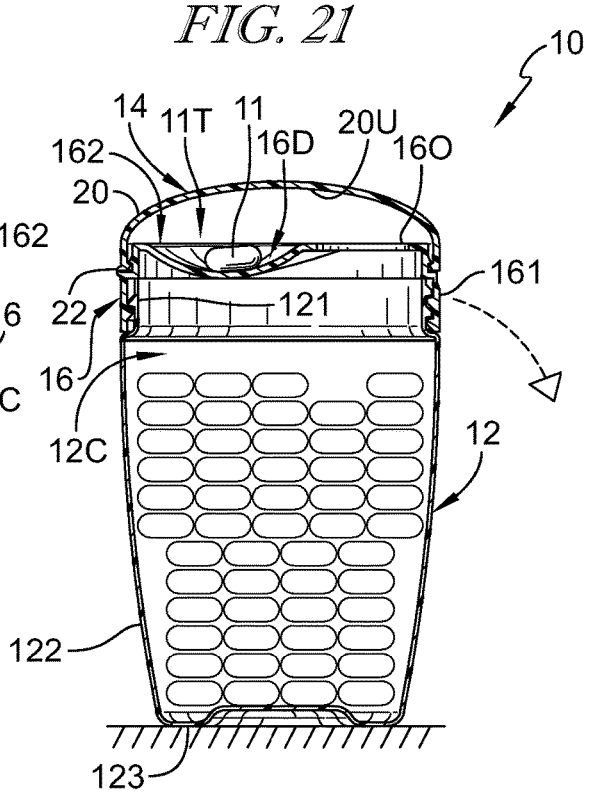

After further rotation of pill dispenser 10 in a counter-clockwise direction away from the partially inverted position of FIG. 21 toward a right-side-up position shown in FIG. 23, the discharged pill 11 is caused to travel in pill-transfer chamber 11T relative to flip-top cap 20 from pill-dispensing outlet 16O toward pill-receiver dish 16D. Once pill dispenser 10 is restored to an upright orientation as suggested in FIG. 23, discharged pill 11 has now fallen into the upwardly facing pill-receiver dish 16D formed in ceiling 162 of body 16 so that it is available to a user upon opening the flip-top cap 20 as suggested in FIG. 16.

Figure 19:
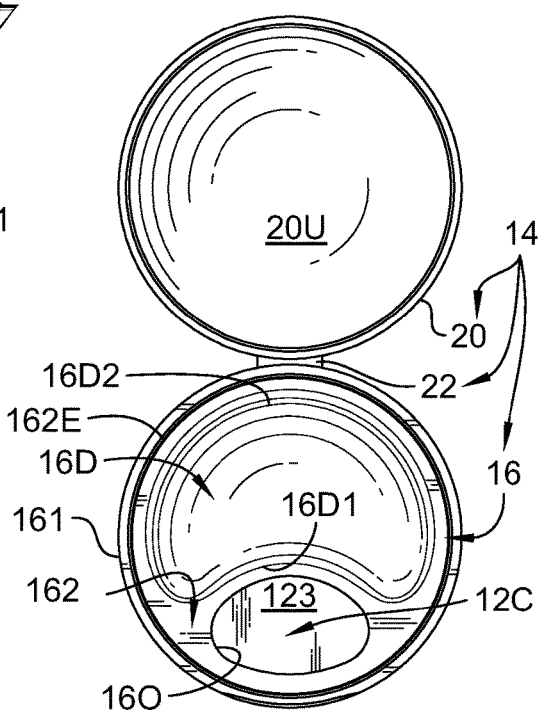
FIG. 19 is a top plan view of the pill dispenser of FIG. 18 when the flip-top cap is moved to assume a fully opened position and showing that a ceiling of the body is formed to include an oval-shaped pill-dispensing outlet along a perimeter edge of the ceiling and a crescent-shaped pill-receiver dish located between the pill-dispensing outlet and the hinge.
Figure 20:
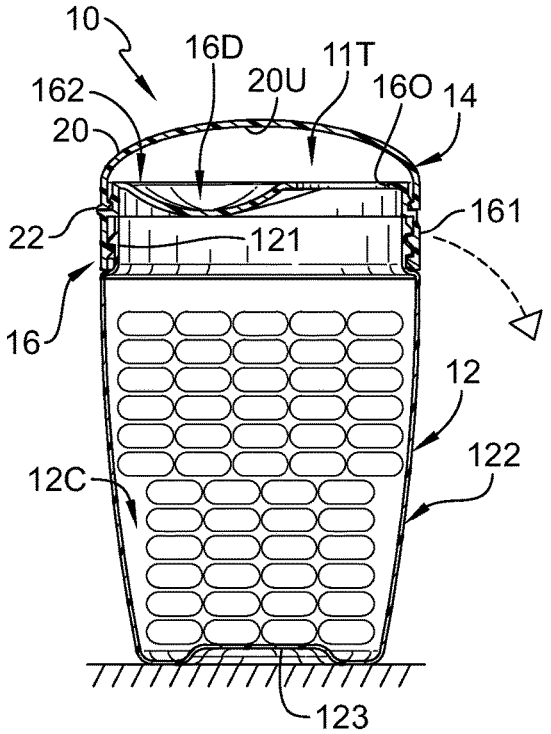
FIGS. 20-23 is a sequence illustrating discharge of a pill from the interior pill-storage chamber formed in the container through the pill-dispensing outlet formed in the ceiling of the body first into a pill-transfer chamber formed between a top side of the ceiling and an underside of the flip-top cap while the flip-top cap remains in a closed position on the body and then into an upwardly opening pill-receiver dish formed in the ceiling and arranged to lie alongside the pill-dispensing outlet.

Pill-dispensing outlet 16O is placed near the perimeter edge 162E of ceiling 162 of body 16 of container closure 14 as suggested in FIGS. 16 and 19. Such placement permits pouring out of the pill 11 when pill dispenser 10 is turned upside down so that the pill 11 in turn flows through pill-transfer chamber 11T and around the dome-shaped underside 20U of flip-top cap 20 and into the pill-receiver dish 16D formed in body 16 of container closure 14 as suggested in FIGS. 20-23. In accordance with the present disclosure, the space provided between underside 20U of flip-top cap 20 and the top surface of ceiling 162 of body 16 can regulate the number of pills that are disbursed and fall to rest in pill-receiver dish 16D.

A foil seal (not shown) can be coupled to brim 121 or container 12 to cover the top aperture outlet into interior pill-storage chamber 12C. Pill-receiver dish 16D has a shallow depth in an illustrative embodiment and can fit over and rest against a top surface of that foil seal without unwanted deformation of the foil seal.

The invention claimed is:

1. A pill dispenser comprising a container formed to include an interior pill-storage chamber therein, the container including a body defining a portion of the interior pill-storage chamber and a neck coupled to the body to define a remaining portion of the interior pill-storage chamber, a container closure coupled to the container, and a neck insert coupled to the neck of the container and arranged to extend downwardly away from the container closure into the interior pill-storage chamber, wherein the neck insert is configured to dispense a single pill from the interior pill-storage chamber through a pill-dispensing outlet formed in the neck insert into a pill-transfer chamber formed between the container closure and the neck insert to maximize control and minimize spilling of pills stored in the interior pill-storage chamber in response to rotating the pill dispenser to a partly inverted position and returning the pill dispenser to a right-side up position, wherein the neck insert includes a horizontal platform formed to include the pill-dispensing outlet and a pill-receiver dish, and a ramp arranged to extend between and interconnect the horizontal platform and the pill-receiver dish so that rotation of the container toward the single pill-dispensing outlet to the partially inverted position causes a pill to pass into the pill-transfer chamber and returning the pill-storage chamber to the right-side up position via rotation of the container via an opposite rotation of the container causes the pill to travel in a pill-transfer region from the single pill-dispensing outlet toward and be received in the pill-receiver dish, wherein the pill-dispensing outlet is the only opening formed in the neck insert, wherein the horizontal platform and the ramp are flat, and the pill-receiver dish is concave, wherein the pill-dispensing outlet is located radially offset from a central vertical axis of the insert so that the central vertical axis intersects the ramp.

2. The pill dispenser of claim 1, wherein the neck insert includes a retaining lip located between the neck and the container closure and the pill-receiver dish coupled to the retaining lip and arranged to extend from the retaining lip into the interior pill-storage chamber away from the container closure.

3. The pill dispenser of claim 2, wherein the pill-receiver dish is arranged to open upwardly away from the container to face toward an underside of the container closure.

4. The pill dispenser of claim 1, wherein the container further includes exterior threading coupled to the neck to locate the neck between the exterior threading and the neck insert.

5. The pill dispenser of claim 4, wherein the container closure includes a rim arranged to extend around and surround the neck, a cap coupled to the rim and arrange to overlie the neck, and interior threading located between the rim and the neck and arranged to engage the exterior threading of the container to couple the container closure to the container.

6. The pill dispenser of claim 1, wherein the container further includes exterior threading coupled to the neck to locate the neck between the exterior threading and the neck insert, the container closure includes a rim arranged to extend around and surround the neck, a cap coupled to the rim and arrange to overlie the neck, and interior threading located between the rim and the neck and arranged to engage the exterior threading of the container to couple the container closure to the container, and the cap engages the neck insert to trap a portion of the neck insert between the cap and the neck of the container.

7. The pill dispenser of claim 6, wherein the neck insert includes a retaining lip providing the portion of the neck insert trapped between the cap and the neck and a pill-receiver dish coupled to the retaining lip and arranged to extend from the retaining lip into the interior pill-storage chamber away from the container closure.

8. The pill dispenser of claim 7, wherein the cap has an underside arranged to face toward the neck insert and the underside has a concave surface arranged to extend upwardly away from the neck insert.

9. The pill dispenser of claim 1, wherein the neck insert includes a retaining lip located between the neck and the container closure, an insert side wall coupled to the retaining lip and arranged to extend downwardly way from the retaining lip and into the interior pill-storage chamber, and a ceiling coupled to the insert side wall and located in spaced-apart relation to the retaining lip so as to be located in the interior pill-storage chamber.

10. The pill dispenser of claim 9, wherein the pill-receiver dish is coupled to the ceiling and to the insert side wall and arranged to lie in spaced-apart relation to the retaining lip so as to be located in the interior pill-storage chamber.

11. The pill dispenser of claim 10, wherein the ceiling is located between the pill-receiver dish and the retaining lip.

12. The pill dispenser of claim 11, wherein the pill-dispensing outlet is formed in the ceiling.

13. The pill dispenser of claim 10, wherein the pill-receiver dish has a concave shape providing an upper curved surface arranged to face toward the container closure and arranged to extend away from the container closure.

14. The pill dispenser of claim 10, wherein the ceiling includes a horizontal platform formed to include the pill-dispensing outlet and a ramp arranged to extend between and interconnect the pill-receiver dish.

15. The pill dispenser of claim 14, wherein the ramp extends downwardly from the horizontal platform to the pill-receiver dish.

16. The pill dispenser of claim 9, wherein the pill-dispensing outlet is formed in the ceiling.

17. The pill dispenser of claim 16, wherein the pill-dispensing outlet has an oval shape.

* * * * *